US006961979B2

(12) United States Patent
Wendle

(10) Patent No.: US 6,961,979 B2
(45) **Date of Patent: *Nov. 8, 2005**

(54) BUNDLING TIE

(76) Inventor: Todd B. Wendle, P.O. Box 305, Post Falls, ID (US) 83854

( * ) Notice: Subject to any disclaimer, the term of this patent is extended or adjusted under 35 U.S.C. 154(b) by 0 days.

This patent is subject to a terminal disclaimer.

(21) Appl. No.: 10/701,147

(22) Filed: Nov. 3, 2003

(65) Prior Publication Data

US 2004/0139583 A1 Jul. 22, 2004

Related U.S. Application Data

(63) Continuation of application No. 10/087,474, filed on Feb. 27, 2002, now Pat. No. 6,640,393.

(51) Int. Cl.[7] ..... B65D 63/00; F16L 3/08

(52) U.S. Cl. ..... 24/16 PB; 24/16 R; 24/17 AP; 24/30.5 P; 248/74.3

(58) Field of Search ..... 24/116 A, 16 R, 24/16 PB, 17 R, 30.5 P, 17 A, 17 AP; 248/74.3

(56) References Cited

U.S. PATENT DOCUMENTS

| | | | | |
|---|---|---|---|---|
| 2,961,785 A | * | 11/1960 | Toepfer | 40/669 |
| 3,072,986 A | | 1/1963 | Lefinaer | |
| 3,255,501 A | | 6/1966 | Laguerre | |
| 3,403,430 A | * | 10/1968 | Steinborn | 24/589.1 |
| 3,597,803 A | | 8/1971 | Van Neil | |
| 3,780,400 A | | 12/1973 | Hinsperger | |
| 4,235,404 A | | 11/1980 | Kraus | |
| 4,466,159 A | | 8/1984 | Burrage | |
| 4,631,783 A | * | 12/1986 | Hayashi | 24/16 PB |
| 4,752,054 A | * | 6/1988 | Jonsson | 248/51 |
| 5,093,964 A | | 3/1992 | Rowland | |
| D342,668 S | * | 12/1993 | Rose et al. | D8/394 |
| 5,395,343 A | | 3/1995 | Iscovich | |
| 5,581,850 A | | 12/1996 | Acker | |
| 5,836,053 A | | 11/1998 | Davignon et al. | |
| 5,881,436 A | | 3/1999 | Lyons | |
| 6,131,200 A | | 10/2000 | McNamara | |
| 6,227,399 B1 | * | 5/2001 | Angus et al. | 220/375 |
| 6,235,987 B1 | | 5/2001 | Gamaggio-Schafer | |
| 6,640,393 B2 | * | 11/2003 | Wendle | 24/16 PB |

FOREIGN PATENT DOCUMENTS

| | | | | |
|---|---|---|---|---|
| DE | 19716864 A1 | * | 11/1998 | B65D/63/10 |
| WO | WO 9011945 A1 | * | 10/1990 | A45F/5/10 |

* cited by examiner

*Primary Examiner*—James R. Brittain
(74) *Attorney, Agent, or Firm*—Gregory I.P. Law; Randy A. Gregory

(57) ABSTRACT

A releasable tie is described in which an elongated strand of flexible material is provided with a first set of three dimensional beads spaced apart along a first length of the strand. A second set of three dimensional beads, formed on the strand are spaced apart along a second length of the strand. A tab formed along the strand includes a first locking slot for releasably receiving the first strand length; and a second locking slot for releasably receiving the second length of the strand.

13 Claims, 5 Drawing Sheets

10
12
14
15
17
18
20
21
22
26
27
32
33
34
37
38
39
52

44
45
44
45

42
44
43
45
44
43
45

52
20
22
21
27
14
12
15

17
18
26
48
17
12

42
A

BUNDLING TIE

CROSS REFERENCE TO RELATED APPLICATION

This is a continuation of U.S. patent application Ser. No. 10/087,474 filed on Feb. 27, 2002 now U.S. Pat. No. 6,640,393. Priority under Section 120 of the Patent Act is claimed.

TECHNICAL FIELD

The present invention relates to ties of the type used for securing objects together, particularly in bundles, and particularly to such ties formed in an elongated configuration.

BACKGROUND OF THE INVENTION

Various tie devices have been developed for the purpose of binding or bundling cables, wires and the like for storage transport. Many of the presently available ties are for single use and are self-locking. That is, the loop formed by the tie is permanent and cannot be broken without destroying the tie.

It is also known to provide a re-usable form of cable tie, in which a flexible strap of substantially rectangular cross-section is provided with serrated or otherwise formed sides or edges that are receivable within and lock with a slotted end of the tie. Such ties are useful but in a limited way because they form only a single useful loop when in use. Other similar strap ties solve this problem by including provisions for a second loop, but make use only of the single set of serrated edges to enable formation of both loops. This limits use or adjustability of the tie.

Further, known forms of ties are formed of flat strap material and do not include raised or other formed surfaces that may be used to indent and grip the article to be fastened and that are also used to releasably lock the tie in a desired loop formation.

BRIEF DESCRIPTION OF THE DRAWINGS

Preferred embodiments of the invention are described below with reference to the following accompanying drawings.

FIG. 12 is an enlarged sectional view taken substantially along line 12—12 in FIG. 9.

DETAILED DESCRIPTION OF THE PREFERRED EMBODIMENTS

Figures 1, 4, 5:
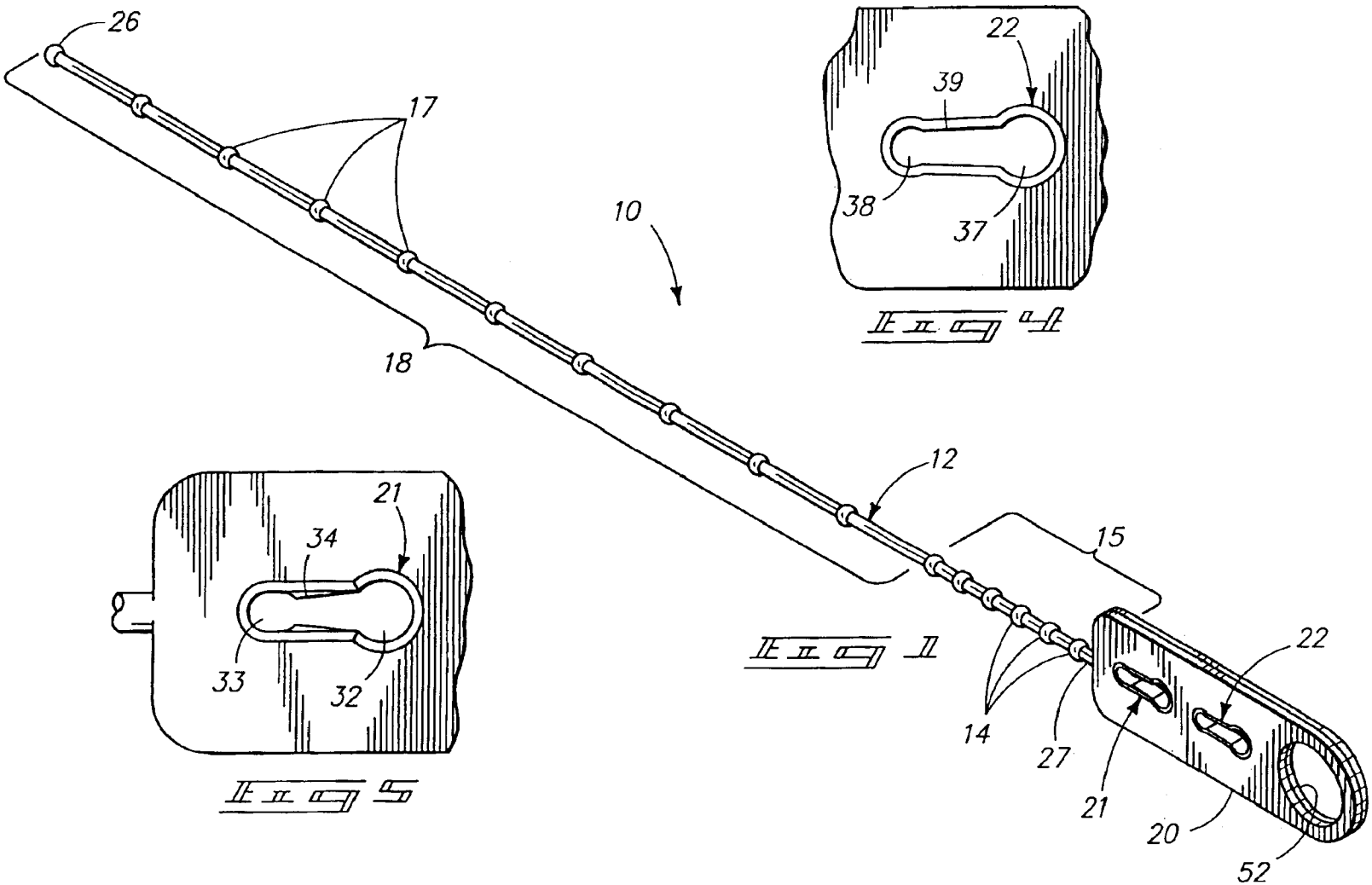
FIG. 1 is a perspective view of a preferred form of the present tie.
FIG. 4 is an enlarged detail view of a second locking slot.
FIG. 5 is an enlarged detail view of a first locking slot.
Figure 2:
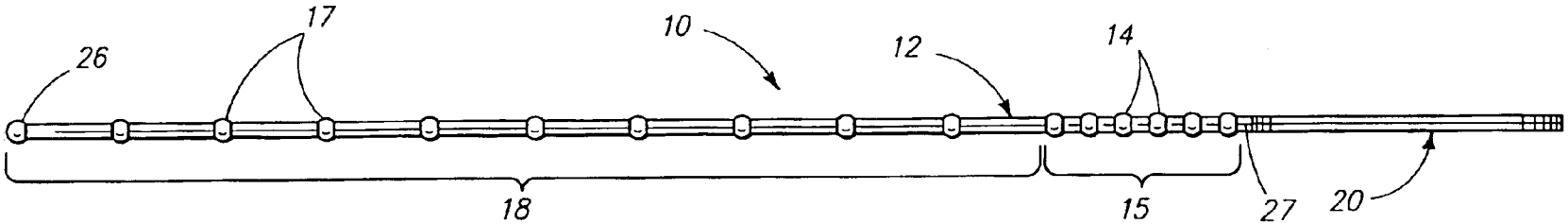
FIG. 2 is a top plan view.
Figure 3:
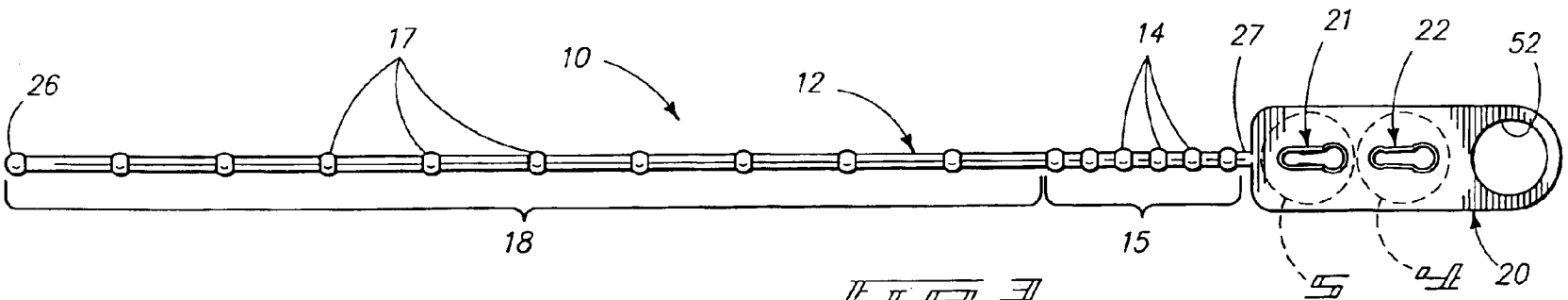
FIG. 3 is a front elevation view.

This disclosure of the invention is submitted in furtherance of the constitutional purposes of the U.S. patent laws "to promote the progress of science and useful arts" (Article 1, Section 8).

In a preferred aspect of the invention, a tie 10 is provided in which at least one elongated strand 12 of flexible material is included. A first set of three dimensional beads 14 is provided along the strand and spaced apart along a first strand length 15. A second set of three dimensional beads 17 are also provided on the "at least one" strand and are spaced apart along a second strand length 18. A tab 20 is formed along the strand and includes a first locking slot 21 shaped to releasably receive the first length 15 and to interlock with one of the beads 14 of the first set. A second locking slot 22 is also provided to releasably receive the second strand length 18 and to interlock with one of the beads 17 of the second set.

Figures 2, 9, 10, 11:
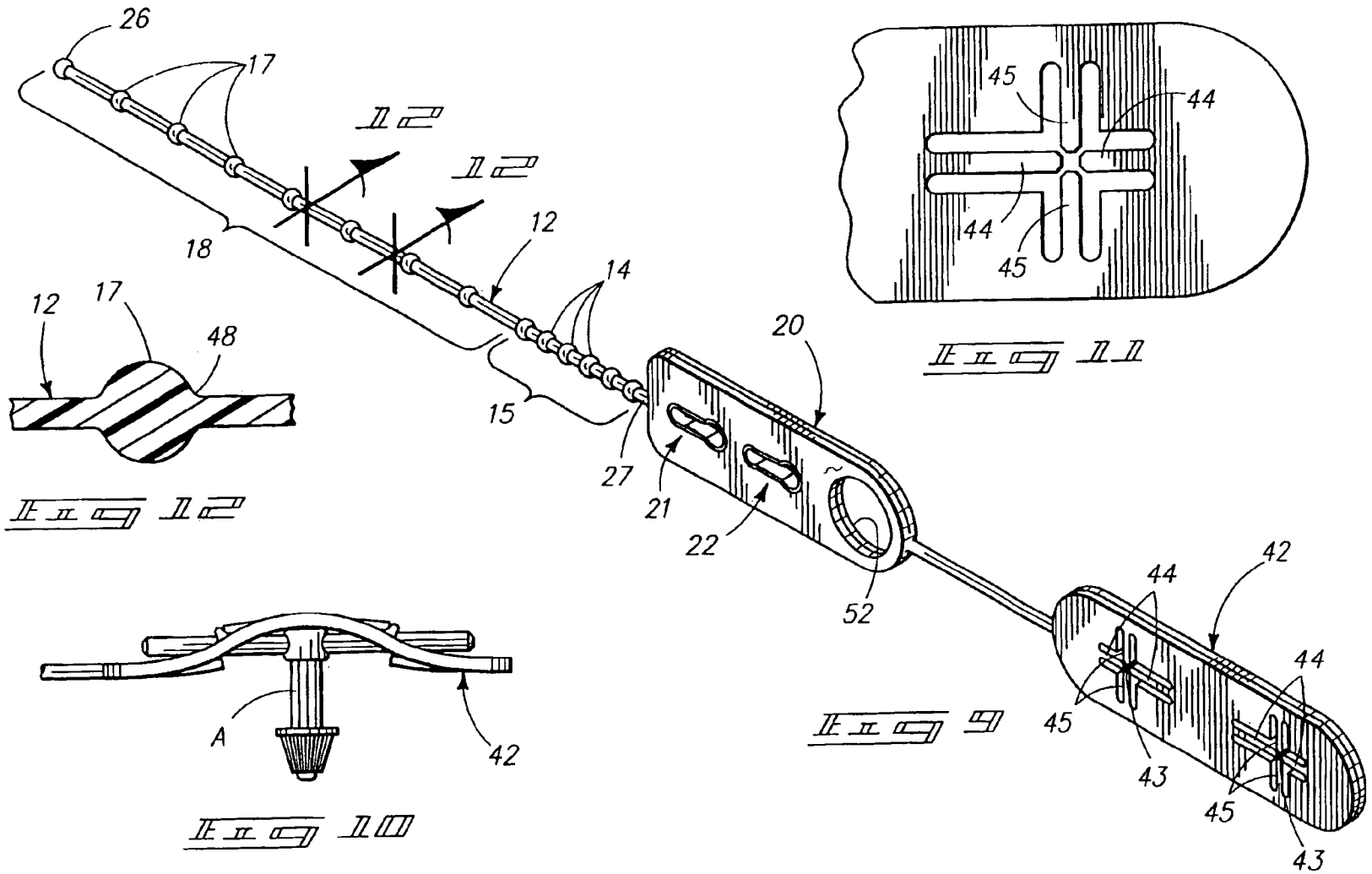
FIG. 9 is a perspective view of a tie including an accessory mounting section.
FIG. 10 is a sectioned diagrammatic view illustrating the accessory mounting section releasably securing a drill chuck key.
FIG. 11 is an enlarged detail view of a portion of the accessory mounting section.
Figure 13:
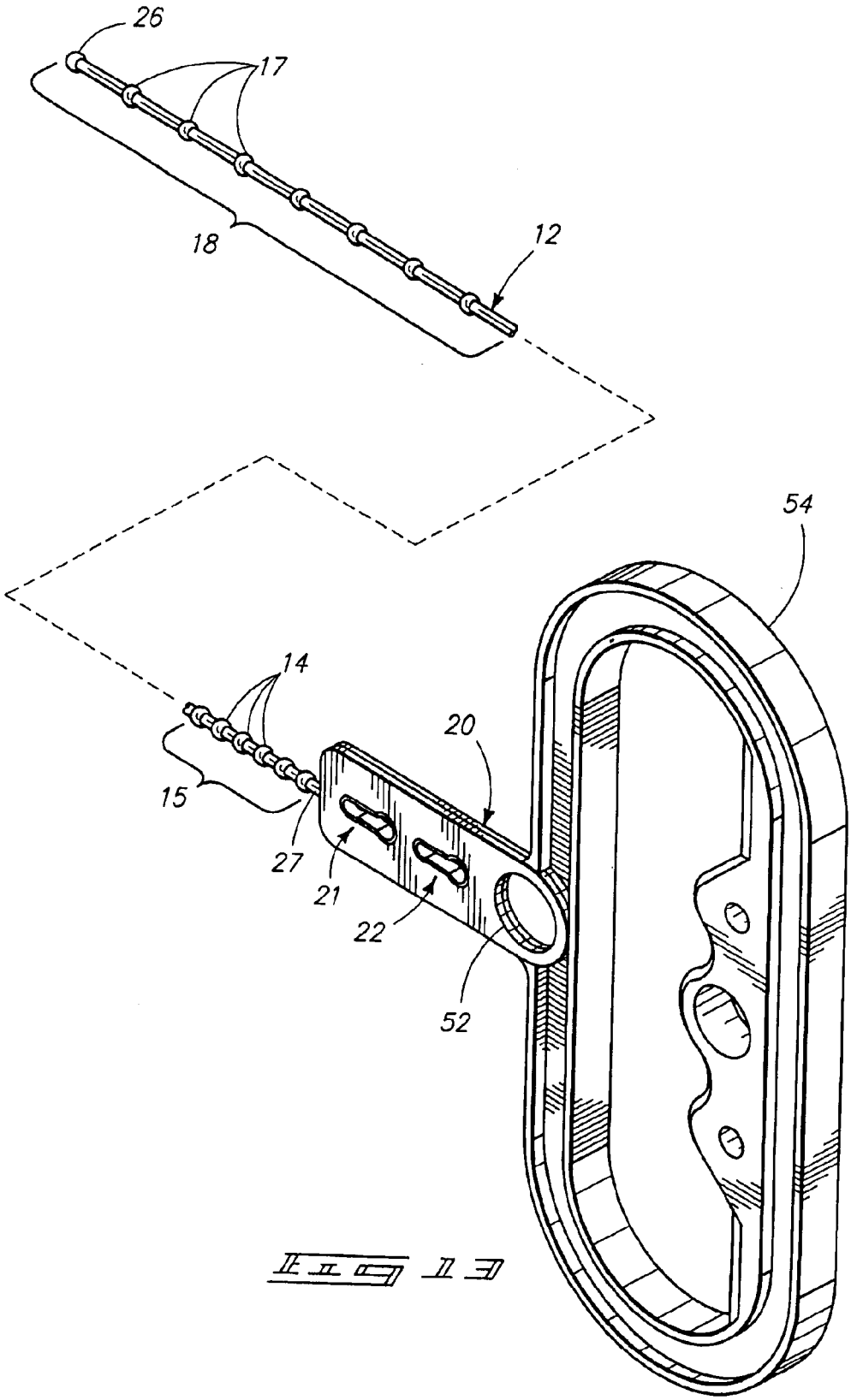
FIG. 13 is a perspective view of a tie with an integrated handle portion.

In referring more particularly to the drawings, it will be seen that three variations of the present tie 10 are exemplified. FIG. 1 is illustrative of a basic form of tie whereas FIGS. 9 and 13 show versions with additional features. Specifically, FIG. 9 is illustrative of a version of the tie in which an accessory carrier 42 is provided. The version illustrated in FIG. 13 includes an accessory handle 54. Aside from these added features, the remaining portions of the tie may be common to all three versions and will be described using identical reference numerals.

The preferred forms of the present tie 10 are formed of a flexible material such as an appropriate plastic. Injected molded nylon is a preferred form, but other materials having relatively high tensile strength could be used as well.

FIG. 12 clearly indicates the integrated nature of the tie, especially along the length of the single illustrated strand portion 12. The illustrated beads on both preferred sets are shown to be formed as an integral part of the single illustrated strand.

The bead illustrated in FIG. 12 is typical of the remaining beads along the length of the strand. The illustrated bead is joined integrally with the strand 12 with integral fillets 48 at the juncture. The beads and fillets add strength to the strand. It should thus be understood that the beads of both sets 14, 17 are immovable along the length of the strand.

Further, it is preferred that the beads of the first set 14 be substantially equally spaced apart. The same is preferable for the beads in the second set 17. However, the beads within the second set are spaced further apart than the beads in the first set for reasons that will be more fully explained below.

The tab 20 is preferably a flattened portion of the tie that is integral with the strand 12. The preferred tab includes the first and second locking slots 21, 22. In preferred forms, a hanger aperture 52 is also provided in the tab to facilitate hanging of the tie and any attached bundle or load (see FIG. 8).

It is pointed out that the preferred form illustrated shows the tab 20 as being situated at an end 27 of the strand (opposite the remaining end 26). However, it is conceivable that the tab 20 could be positioned at a different location along the strand. For example, it is possible that the tab portion could be situated between the first and second sets of beads. It is also possible that the two sets of beads be formed along separate portions of the tie. For example, the second length 18 could be mounted in one position integrally with the tab 20, and the second length 15 could be a separate part and be integrally connected to the tab as well. In other words, the two lengths 15 and 18 are not necessarily coaxial with one another or formed along a single strand.

Reference will now be made with respect to the tab 20 and the first and second locking slots 21, 22. Details of the individual slots are shown in FIGS. 4 and 5.

The first locking slot 21 is configured to receive the first set of beads 14. An enlarged opening 32 is provided at one end of the slot. The slot leads from the enlarged opening 32 to a reduced opening 33. An intermediate necked down section 34 is provided between the openings 32 and 33.

The reduced opening 33 is approximately the same diameter as the strand 12, and the necked down section 34 reduces the opening size to a dimension less than the strand diameter. Thus, the first length 15 of the strand may be selectively snapped into and locked in position within the first locking slot 21.

It is likely that the present tie 10 will be somewhat permanently attached to a cord or other structure and the need for removability will not be a necessity. However, it is possible to disengage the strand 12 and first set of beads 14 from the first locking slot by applying sufficient force to the strand 12 to compress the strand through the necked down section 34 and thereby allow disengagement of the strand from the tab.

The second locking slot 22 is intended for use with the second set of beads 17 along the second length 18. The second locking slot 22 includes an enlarged opening 37, a reduced opening 38, and a necked down opening 39 connecting the enlarged and reduced openings 37, 38. It is pointed out that this locking slot is slightly different from the first locking slot 21 in that the necked down opening may not be as reduced in dimension as the counterpart section 34 of the first locking slot. Thus, the beads of the second set and second length 18 may be selectively locked or latched and unlocked repeatedly with a reduced unlatching force than that required for unlocking the first set of beads 14 from the first locking slot 21.

Attention is drawn now to FIGS. 9–11 which illustrate a form of an accessory mounting section 42. The accessory mounting section 42 is formed as part of or in a similar manner to the tab 20 and may be connected by a short length of strand similar to the strand 12.

The section 42 preferably includes two spaced apertures 43. A typical aperture configuration is shown in the enlarged fragmentary detail view of FIG. 11. Each aperture 43 is preferably defined by opposed longitudinally oriented latching tongues 44 and opposed laterally oriented latching tongues 45.

Ends of the tongues are situated adjacent one another in a normal, closed orientation. However, the tongues may be displaced or bent by insertion of a accessory A such as a drill chuck key, allen wrench, or other accessory. An exemplary accessory (a drill chuck wrench) is shown in FIG. 10 in which the handle portions of the illustrated drill chuck wrench have been inserted through the apertures 43 by displacing the tongues 44, 45. It is preferred that the section 42 be formed of a flexible, somewhat resilient material such as nylon so the tongues will deflect and effectively clamp the accessory in a secure but removable position.

In addition to or in place of the accessory mounting section 42, a carrying handle may be provided as indicated at 54 in FIG. 13. The handle 54 may be formed of the same material as the remainder of the tie 10 and have sufficient dimension to allow insertion of one or more fingers for carrying purposes, or for enabling the tie and engaged bundle to be hung.

Figure 6:
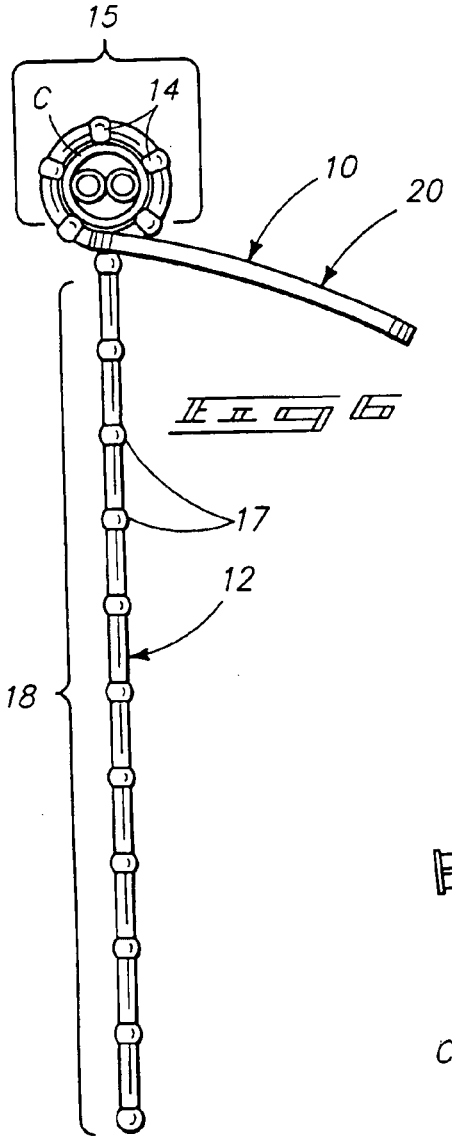
FIG. 6 is a diagrammatic view illustrating the tie connected to a cord or other workpiece.

Operation of the invention is described with reference to the FIGS. 6–8. The examples illustrated there identify a bundled workpiece such as a cord, tubing, hose, or other workpiece.

If it is desired to attach the tie 10 in a semi-permanent relationship to the workpiece, the first set of beads 14 and first locking slot 21 are used to secure the tie to one portion of the workpiece. This is illustrated in FIG. 6 where the first length 15 has been looped around the illustrated cord C and the strand 12 has been inserted through the enlarged opening 32 of the first locking slot 21. The loop is pulled snug about the cord C until the beads 14 of the first set engage and indent or firmly grip the cord. The strand part now engaged in the locking slot 21 is then moved into and past the necked down section 34 to snap into the reduced opening 33. Since the beads 14 and 17 are larger than the reduced opening 33, there is little danger that the tie will slip loose from the firmly engaged orientation.

Figure 7:
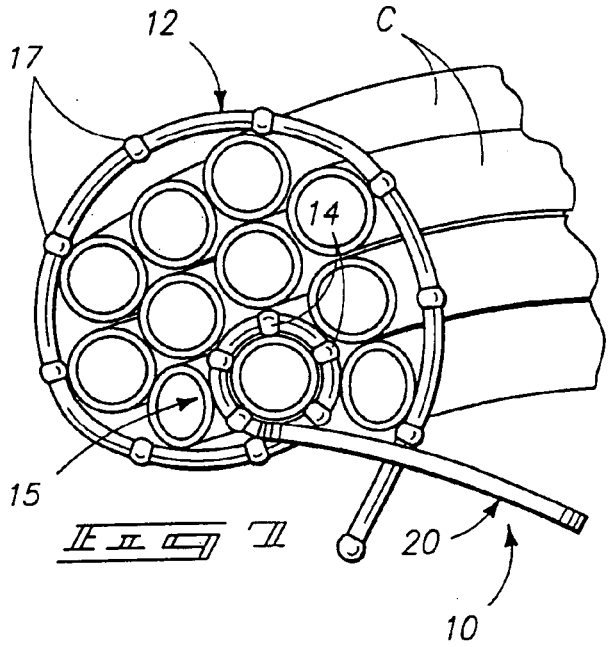
FIG. 7 is a diagrammatic view of the tie secured about a bundle.
Figure 8:
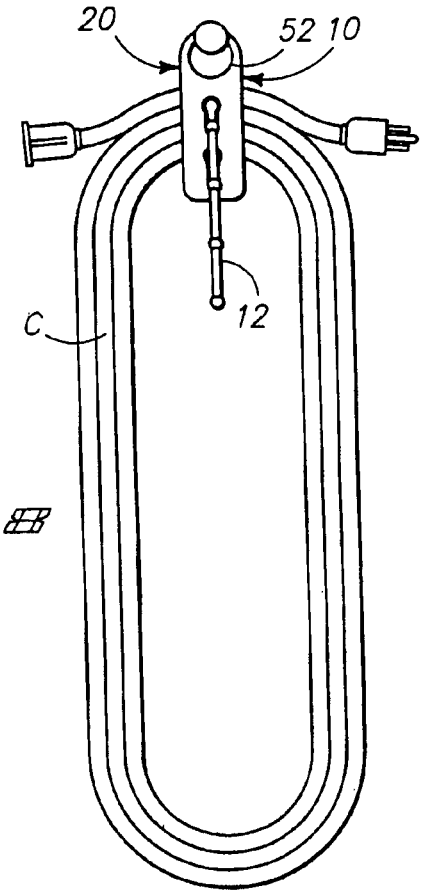
FIG. 8 is a diagrammatic view illustrating the cord securing a bundled extension cord.

If it is desired to wrap the tie 10 about a bundle as indicated in FIGS. 7 and 8, a second loop may be made about the bundle by extending the second flank 18 about the bundled material and by inserting the strand end 26 through the second locking slot 22. The strand is pulled through the slot until the bundle is firmly gripped. The strand is then shifted from the enlarged opening 32, past the necked down opening 39, and into the reduced opening 38. This is again a form of snap fit. The strand will not move longitudinally once locked in position since the beads are significantly larger than the reduced opening 38. Thus, the bundle is secured. Now the hanger hole 52 may be utilized if desired to hang the secured bundle as generally indicated in FIG. 8.

Should the user wish to gain access to the bundled material, he or she need only to snap the strand laterally from engagement within the reduced opening 38 back through the necked down opening 39 and into the enlarged opening 37. The strand may then be pulled from engagement with the second locking slot 22, thereby opening the second loop and freeing the bundle for use.

The first loop, formed by the tab and first strand length 15 will stay in engagement with the single portion of the material, with the second length 18 and locking slot 21 awaiting further use should it be desired to once again secure the material in a bundle form. The tie 10 is thus readily re-usable.

Operation as indicated above is similar, if not, identical with versions including an accessory mounting section 42 or with the handle portion 54. However, in the case of the accessory mount, the additional mount serves to provide a secure carrier for an accessory such as a drill chuck. Therefore, if the device is to be used on the cord for an electric drill, the accessory carrier can be used for releasably securing an accessory drill chuck key. Additionally, the strand can be used along with the tab and second locking slot 22 to secure the drill cord in a neat bundle.

In embodiments including an integral handle 54, the same procedures may be used for connecting the tie to an article then attachment of the tie to a bundle or other arrangement of one or more workpieces. The handle then becomes available for carrying or hanging the secured bundle.

It is noted that tension applied along the strand will produce a shearing force against the portion of the bead engaged at the associated reduced opening of the tab. The fillets 48 and bead structure serve to strengthen the bead against shearing. This is an advantage over prior forms of ties which include serrations or indentations that reduce the dimension of the strap or tie material and therefore create stress risers at which the ties may break when under tension.

In addition, the somewhat spherical configuration of the beads is advantageous in that the bead surfaces have a tendency to indent and grip against the engaged article. Thus, there is less of a tendency for the present tie 10 to migrate or shift along the engaged article.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus forming a bundling tie, said bundling tie being capable of both being securely attached to a single portion of a workpiece at a first tie loop and easily connected and disconnected about a bundle formed of multiple workpiece portions at a second tie loop, comprising:

a locking portion having a first locking slot and a second locking slot, said first and second locking slots being closed openings having respective first and second enlarged ends and respective first and second narrow ends with respective first and second intermediate necked down sections respectively between said first and second enlarged ends and said first and second narrow ends;

a strand connected to said at least one locking portion;

a plurality of three dimensional locking features spaced along the strand which are capable of passing through the enlarged ends of the first and second locking slots but incapable of passing through the narrow ends of the first and second locking slots;

wherein said first and second locking slots are oriented in the locking portion such that the first and second reduced openings are positioned towards a connection between the strand and the locking portion;

and wherein said first locking slot has a smaller necked down intermediate section as compared to a larger necked down intermediate section of the second locking slot;

whereby the first locking slot may lock with a three dimensional locking feature on said strand to form the first tie loop that securely engages a workpiece section and locks thereto, and the second locking slot may lock with another three dimensional locking feature on said strand to form the second tie loop that is used to hold a bundle of sections of the workpiece and which can be unlatched with a reduced unlatching force compared to the unlatching force needed for said first locking slot.

2. An apparatus according to claim 1 wherein the strand has two sections, a first section connected to the locking portion at a strand connection and having locking features which are more closely spaced as compared to a second section having which is further from said strand connection and has less frequent locking features thereon.

3. An apparatus according to claim 1 and further comprising an accessory holder connected to said locking portion.

4. An apparatus according to claim 1 and further comprising a hanging hole in said locking portion.

5. An apparatus according to claim 1 and further comprising a handle connected to said locking portion.

6. An apparatus according to claim 1 and further comprising:

a handle connected to said locking portion;

at least one hanging hole on said locking portion or said handle.

7. An apparatus forming a bundling tie, said bundling tie being capable of both being securely attached to a single portion of a workpiece at a first tie loop and easily connected and disconnected about a bundle formed of multiple workpiece portions at a second tie loop, comprising:

a locking portion having a first locking slot and a second locking slot, said first and second locking slots being closed openings having respective first and second enlarged ends and respective first and second narrow ends with respective first and second intermediate necked down sections respectively between said first and second enlarged ends and said first and second narrow ends;

a strand connected to said at least one locking portion;

a plurality of three dimensional locking features spaced along the strand which are capable of passing through the enlarged ends of the first and second locking slots but incapable of passing through the narrow ends of the first and second locking slots;

wherein said first locking slot has a smaller necked down intermediate section as compared to a larger necked down intermediate section of the second locking slot;

whereby the first locking slot may lock with a three dimensional locking feature on said strand to form the first tie loop that securely engages a workpiece section and locks thereto, and the second locking slot may lock with another three dimensional locking feature on said strand to form the second tie loop that is used to hold a bundle of sections of the workpiece and which can be unlatched with a reduced unlatching force compared to the unlatching force needed for said first locking slot.

8. An apparatus according to claim 7 wherein the strand has two sections, a first section having locking features which are more closely spaced than locking features on a second section.

9. An apparatus according to claim 7 wherein the strand has two sections, a first section connected to the locking portion at a strand connection and a having locking features which are more closely spaced as compared to a second section having which is further from said strand connection and has less frequent locking features.

10. An apparatus according to claim 7 and further comprising an accessory holder connected to said locking portion.

11. An apparatus according to claim 7 and further comprising a hanging hole in said locking portion.

12. An apparatus according to claim 7 further comprising a handle connected to said locking portion.

13. An apparatus according to claim 7 and further comprising:

a handle connected to said locking portion;

at least one hanging hole on said locking portion or said handle.

* * * * *